US005690230A

United States Patent [19]

Griffith

[11] Patent Number: 5,690,230

[45] Date of Patent: Nov. 25, 1997

[54] DISPENSING CONTAINER FOR SMALL FLAT ITEMS

[75] Inventor: J. Martin Griffith, Knoxville, Tenn.

[73] Assignee: DeRoyal Industries, Inc., Powell, Tenn.

[21] Appl. No.: 627,679

[22] Filed: Apr. 2, 1996

[51] Int. Cl.[6] ..... B65D 1/34

[52] U.S. Cl. ..... 206/555; 206/494; 229/122.1; 229/242; 221/47

[58] Field of Search ..... 206/494, 449, 206/555, 499; 229/122, 122.1, 240, 242; 221/303, 305, 306, 33, 47

[56] References Cited

U.S. PATENT DOCUMENTS

| | | | |
|---|---|---|---|
| 3,568,883 | 3/1971 | Reynolds . | |
| 4,004,691 | 1/1977 | Wihksne | 229/122 |
| 4,170,325 | 10/1979 | Pawlowski et al. | 229/122.1 |
| 4,511,043 | 4/1985 | Roccaforte . | |
| 4,566,607 | 1/1986 | Smith | 221/305 |
| 4,592,914 | 6/1986 | Kuchenbecker | 229/122 |
| 4,838,424 | 6/1989 | Petzelt | 229/122 |
| 4,982,845 | 1/1991 | Prascak et al. . | |
| 4,989,730 | 2/1991 | Lemoine | 221/303 |
| 5,460,322 | 10/1995 | Carlson et al. | 229/122 |

*Primary Examiner*—Paul T. Sewell
*Assistant Examiner*—Nhan T. Lam
*Attorney, Agent, or Firm*—Paul E. Hodges, P.C.

[57] ABSTRACT

A dispensing container for a plurality of like flat, thin products disposed in stacked relationship within the container and including a tear-away closure tab whose removal results in an opening through a front panel of the container through which the level of products within the container may be observed and individual ones of the products may be removed from the container. The opening is defined by a unique plurality of perforations and cuts through the thickness of the front panel of the container and has a profile resembling an inverted funnel. A blank for making the carton from a single sheet of material is disclosed.

7 Claims, 3 Drawing Sheets

DISPENSING CONTAINER FOR SMALL FLAT ITEMS

FIELD OF INVENTION

This invention relates to containers for a plurality of a given product and from which individual ones of the product is readily dispensed. The product is substantially flat, thin and disposed in stacked array within the container.

BACKGROUND OF INVENTION

Dispensing cartons or containers for a stacked array of a plurality of a given product have been proposed in the prior art. One such dispenser carton is that disclosed in U.S. Pat. No. 3,568,883. The carton of this patent defines a generally square cross-sectional cavity for receiving a stack of the product items and is provided with a bottom which includes an inclined rear wall and a flat horizontal bottom wall that defines a perforated tear-out and an accompanying insert tab. In use, the perforated tear-out and the insert tab are removed to reveal a narrow elongated opening which is substantially coextensive with the bottom of the container. That is, essentially the entire bottom of the container is open. To avoid the product items from falling from the open bottom, the carton is provided with a sloping back wall adjacent the bottom and the product items are thereby caused to assume a non-horizontal attitude within the carton such that friction between a product and the front wall of the carton retains the product items within the carton until they are grasped and forceably withdrawn. This carton is unsuitable for containing and dispensing substantially flat, thin products in that the products do not possess sufficient surface area along a side thereof which will develop the required friction to retain the products within the carton.

Other dispensing cartons or containers are known to exist wherein products held within the container are dispensed through an open slot at or near the bottom of the front wall of the carton. In these dispensing cartons, the slot is initially closed, and opened in use, as by the tearing away of a closure tab. The known prior art closure tabs of this type which include perforations for weakening the strength of the carton around the periphery of the tab suffer from various shortcomings, such as difficulty in tearing away the tab due to the design of the perforations and/or the difficulty in accomplishing initial puncture of the perforations when attempting to remove the closure tab. Frequently, the forces required to initiate tab removal seriously damage the integrity of the carton. Still further, after initiation of the tab removal, further rupture of the perforations can also result in damage to the carton. This is true especially where the tab includes corners so that the direction of tear changes as the process of removing the tab continues and the forces experienced by the main body of the carton are greater than the strength of the material of which the carton is made. Paperboard and laminated paperboards are particularly vulnerable to this problem. These carton construction materials, however, are widely used for cost reasons.

It is an object of the present invention to provide a dispensing container for flat, thin products.

It is another object to provide a dispensing carton for flat, thin products wherein the carton includes a dispensing opening which is initially closed by a tear-away closure tab that includes a portion thereof which is more readily torn away from the body of the carton to establish an initial opening for effecting further tearing away and removal of the closure tab.

It is another object to provide a dispensing carton for flat, thin products including a tear-away closure tab having a pattern of perforations about its periphery which enhance the ease of removal of the closure tab for exposing products contained within the carton for removal from the carton.

It is another object to provide a blank for the formation of a dispensing container for flat, thin products.

SUMMARY OF INVENTION

Figure 1:
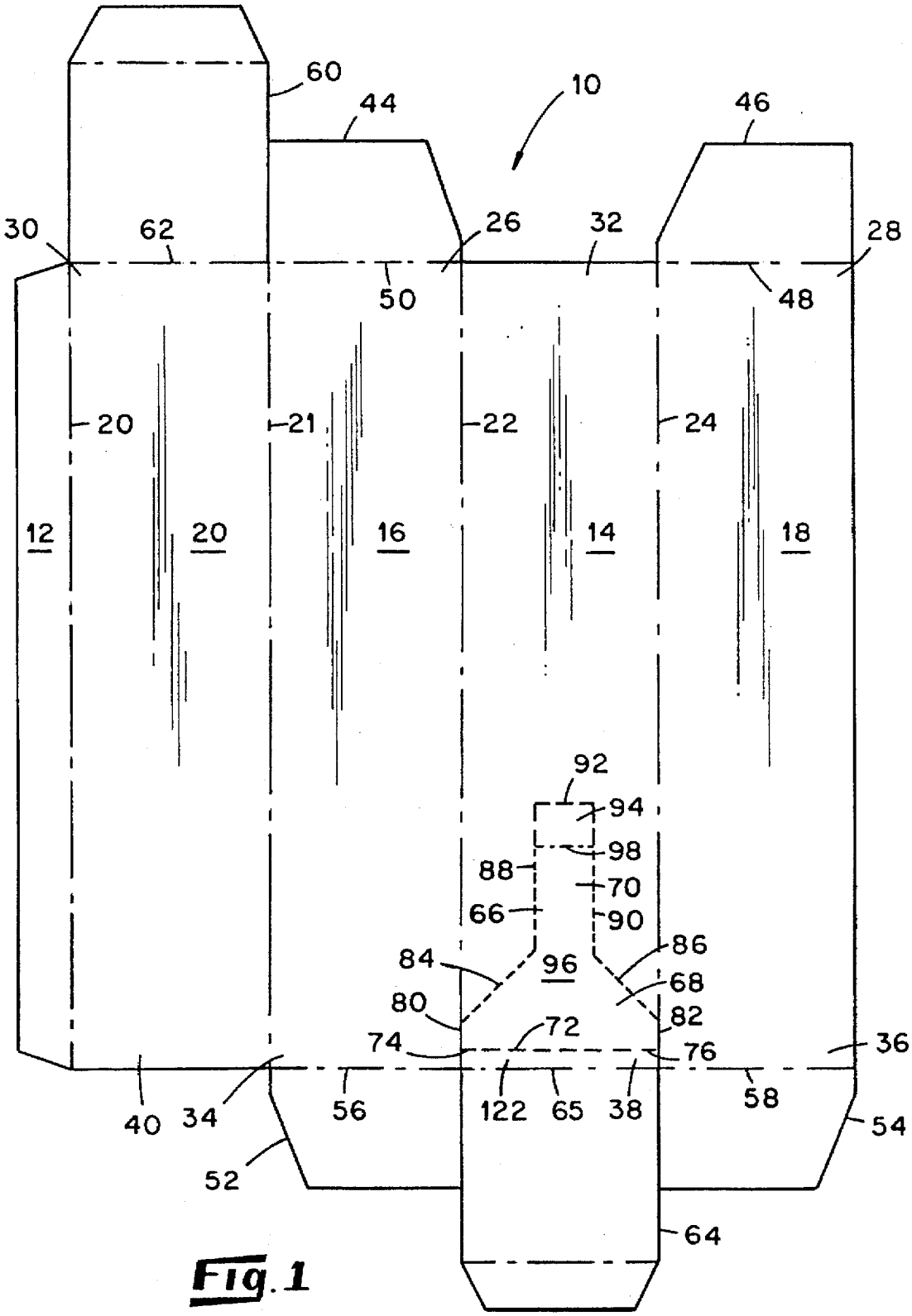
FIG. 1 is a plan view depicting a layout of a blank from which the container of the present invention may be formed.

In accordance with one aspect of the present invention, there is provided a blank for a dispensing carton, designed to be used in an erect position, the blank being formed from a single sheet of material such as paperboard or laminated paperboard. The blank includes consecutively articulated, rectangular panels, including a glue panel, a first side panel, a rear panel, a second side panel and a front panel. First and second dust flaps are articulatingly joined to the bottom ends of the first and second side panels, respectively. A top closure panel is articulatingly joined to the top edge of the rear panel and a bottom closure panel is articulatingly joined to the bottom edge of the front panel. Adjacent the bottom edge of the front panel there is provided a tear-away closure tab defined about its periphery by a unique pattern of perforations and cuts that extend preferably fully through the thickness of the front panel.

In a preferred embodiment, the closure tab is of a planar geometry that resembles the profile of an inverted funnel. More specifically, the closure tab includes a truncated pyramidal base section having an apex and a base which extends substantially fully across the width dimension of the front panel at a location spaced apart from and above the bottom end of the container. Further, the closure tab includes a neck section which extends along the longitudinal centerline of the front panel in a direction away from, and is a continuation of, the apex of the base section. The neck section is divided into upper and lower portions by a horizontal fold line. The upper portion of the closure tab is provided with elongated perforations which are separated by very small non-perforated portions of the front panel of the container body, thereby rendering this top portion readily and easily torn away from the front panel as by pushing inwardly on the top portion to cause it to tear away and project into the container. Preferably, the opposite top corners of the closure tab are fully perforated and thereby unattached to the front panel. As noted this top portion of the closure tab is provided with a terminus in the form of a creased fold line that extends across the width of the neck section. This fold line enhances the ease of the inwardly tearing away of the upper portion and limits the extent of the opening which is initially formed in the front panel as the closure tab is being removed. The remaining vertical length of the neck section of the closure tab is connected to the front panel by a pattern of perforations which present substantial resistance to tearing away of the closure tab from the front panel, this resistance being sufficient to ensure integrity of the container and the closure tab during manufacturing, shipping and storing conditions. This pattern of perforations continues along opposite slanting sides of the closure tab to locations on the respective opposite side edges of the front panel. At these locations, the perforations cease and the vertical opposite sides edges of the closure panel are fully cut-away from the front panel as by a single perforation along each side edge of the closure tab. The junctures at which the pattern of perforations change from a vertical to diverging oblique directions toward the side edges of the front panel defines respective angles of about 135 degrees and thereby aid in preventing damage to the front panel when the closure tab is torn away. The horizontal base of the closure tab is provided with a pattern of perforations which provides limited resistance to the tearing away of the base of the closure tab from the front panel. This pattern of perforations may be of various designs, but one suitable design comprises long perforations that are spaced apart by very small (short) non-perforated regions. In any event, each of the bottom corners formed between the base of the closure tab and the vertical side edges of the front panel preferably are fully perforated and thereby unattached to the front panel to reduce the likelihood of damaging of the carton at these corners as the closure tab is being torn away from the front panel.

In a preferred embodiment, the opening initially formed in the front panel by the tearing away of the neck upper portion of the closure tab is of a size which is sufficient only to permit the insertion therethrough of the first distal joint of a finger. A finger inserted in this initial opening is bent at the first distal joint thereof to form a type of hook to engage the closure tab such that a pulling force applied by the finger, in a direction outwardly of the container, to the neck portion of the closure tab serves to rupture the remaining non-perforated portions of attachment between the closure tab and the front panel and effect a complete tearing away of the closure tab from the front panel. As noted, by reason of the different patterns of perforations along the periphery of the closure tab, especially at the corners thereof, little or no damage is inflicted upon the front panel by the action of tearing away of the closure tab.

DETAILED DESCRIPTION OF INVENTION

With reference to FIG. 1, the blank 10 of the present invention comprises a plurality of articulated panels, including a glue flap 12, a front panel 14, opposite side panels 16 and 18, and a rear panel 20. These panels are joined along parallel fold lines 20, 21, 22, and 24 which extend from the top ends 26, 28, 30 and 32 of the panels to the bottom ends 34, 36, 38, and 40 of the panels (as viewed in FIG. 1). Dust flaps 44 and 46, are articulatingly joined to the top ends 26 and 28 of the side panels 16 and 18, along fold lines 48 and 50, respectively, and dust flaps 52 and 54 are articulatingly joined to the bottom ends 34 and 36 of the side panels 16 and 18, along fold lines 56 and 58, respectively. A top closure flap 60 is articulatingly joined to the top end 30 of the rear panel 20 as by a fold line 62. A bottom closure flap 64 is articulatingly joined to the bottom end 32 of the front panel 14 as by fold line 65.

At a location spaced above the bottom end 32 of the front panel 14 there is provided a series of different patterns of inline perforations that define a tear-away closure tab 66 of the front panel. In the preferred embodiment, this tear-away tab has a profile similar to an inverted funnel and comprises a base section 68 which is likened to the mouth end of a funnel and a neck section 70 which is likened to the neck of a funnel. Accordingly, the perimeter of the tear-away tab includes a perforated base line 72 which is substantially parallel to the fold line 65 and is spaced above the fold line by a short distance, e.g. about ¼ inch. At each the opposite ends 74 and 76 of the base line 72, the perimeter of the tear-away tab turns 90 degrees upwardly from the base line and along the fold lines 22 and 24 for a short distance, e.g. about ⅜ inch, to define short side lines 80 and 82, and thereupon turns obliquely inwardly and convergingly to define oblique side lines 84 and 86. Prior to fully converging, e.g. at a separation distance of about ¾ inch, the oblique side lines 84 and 86 each turns vertically upwardly parallel to the fold lines 22 and 24 to define neck side lines 88 and 90. These neck side lines terminate at a location which is spaced above the fold line 65 by a distance of about ⅕ to ⅓ of the vertical height of the front panel, this distance being sufficient to define an opening 91 (FIG. 4) in the front panel 14 which will expose a plurality of the product items 93 (FIG. 4) contained within the container when the tear-away tab 66 is removed from the front panel. The neck side lines 88 and 90, at their respective upper terminus, turn inwardly of the front panel to join and define a top side line 92 of the tear-away tab. As depicted, the neck portion of the tear-away tab is divided into upper and lower portions 94 and 96 as by a fold line 98.

In accordance with one aspect of the present invention, the ease with which different portions of the tear-away tab may be removed from the front panel is selectively chosen. This is accomplished by means of selectively placed cut lines and a plurality of unique patterns of perforations at selected locations along the periphery of the tear-away tab, in combination with the fold line 98 that separates the neck section of the tear-away tab of the front panel into upper and lower portions 94 and 96, respectively. More specifically, at all ninety degree corners of the profile of the tear-away tab, the corner is defined by a cut line, such as the cut lines 100, 102, 104 and 106, which extends fully around each corner such that there is no resistance to tearing away of the tear-away tab at these corners. By this means, the ease of removal of the tear-away tab is enhanced, and importantly, the cut lines at the corners prevent damage to the remainder of the front panel by the action of tearing away of the tear-away tab.

Further, the side lines which define the profile of the tear-away tab comprise different patterns of perforations, each pattern being selected to provide a different resistance to the tearing away of a given portion of the tear-away tab. In a preferred embodiment, as depicted in the several Figures, the top side line 92 is defined by one or more of perforations 110 that are relatively long and are separated by a very short uncut portion 112 of the front panel to provide minimal resistance to the rupture of these uncut portions between the perforations. As noted, the corners 104 and 106 of the upper portion 94 of the neck section are fully cut through the thickness of the front panel, thereby offering no resistance to tearing. This pattern of perforations is continued from the top corners of the neck section downwardly along the neck side lines 88 and 90 to the fold line 94, thereby providing for minimal resistance to a force applied in a direction inwardly of the erected container, to the upper section of the neck section. In contrast, those lengths of the neck side lines 88 and 90 which extend along the opposite sides of the upper portion of the neck section are defined by relatively short perforations 114 so that there is a greater number of uncut portions 116 of the front panel per lineal inch of each such length of the neck side lines, thereby providing relatively greater resistance to the tearing away of the tear-away tab along these portions of the neck side lines.

This pattern of relatively closely spaced perforations is continued along each of the opposite oblique side lines 84 and 86 for the same purposes.

As noted, the opposite bottom side lines 80 and 82 are fully cut through the thickness of the front panel. Likewise, the corners 74 and 76 defined between the side lines 80 and 82 and the bottom side line 72 are fully cut through so that there is no resistance to tearing along the side lines 80 and 82 and at the corners 74 and 76. The bottom side line 72 is provided with a still further pattern of perforations 118 wherein the individual perforations are relatively long and are separated by relatively short uncut portions 120 of the front panel, thereby providing for relative ease of tearing away of the tear-away tab along this bottom side line. This factor is important in ensuring that no damage occurs to that bottom portion 122 of the front panel which remains after the tear-away tab has been removed. As will be evident hereinafter, this remaining portion 122 of the front panel serves to retain product items within the container after the tear-away tab has been removed and therefore must retain its integrity.

In one example of the perforation patterns, employing a paperboard of about 40 lb per 3000 $ft^2$, the individual perforations which define the side lines of the upper portion 94 of the neck section of the tear-away tab may be about ¼ inch long and spaced apart by an uncut portion of the front panel that is about 1/24 inch long. Along those lengths of the side lines 88 and 90 which bound the opposite sides of the lower portion of the neck section, and along the opposite oblique side lines 84 and 86, the individual perforations 114 may be about 1/12 inch long and spaced apart by an uncut portion 116 of the front panel that is about 1/24 inch long. Along the bottom side line 72, the perforations 118 of this example may comprise a pattern of perforations, for example, ¼ inch long. In this pattern, the individual perforations are separated by uncut portions of the front panel which are each about 1/24 inch long. In all instances, each perforation preferably comprises a cut through the full thickness of the front panel.

Figure 2:
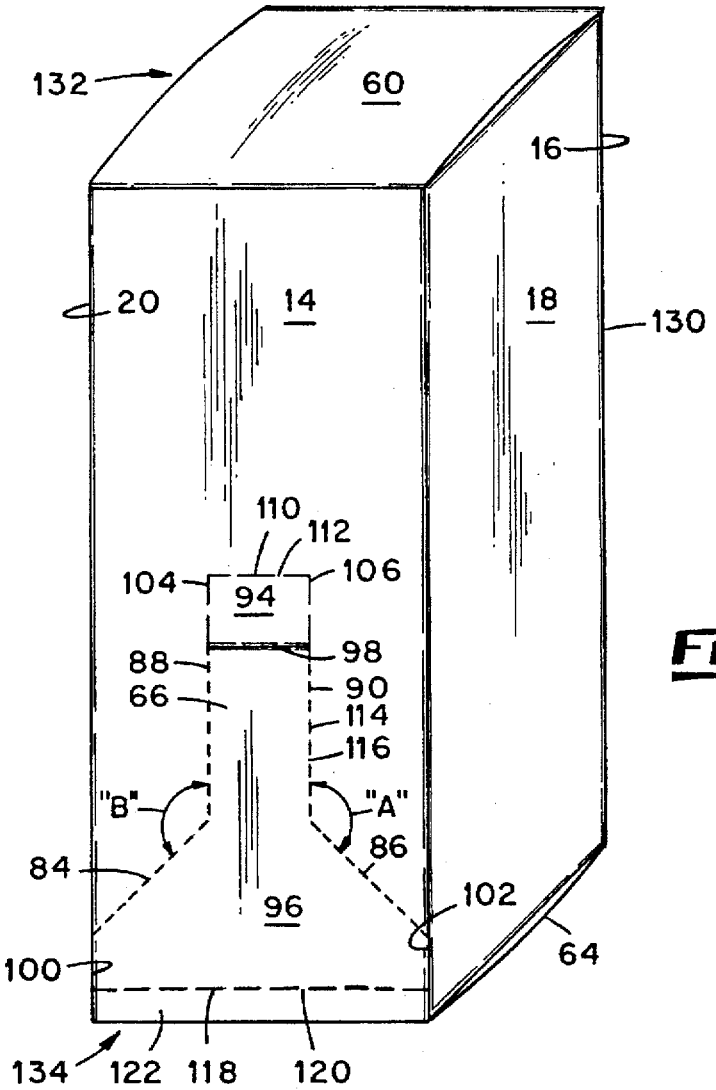
FIG. 2 is a perspective view of a container embodying various of the features of the present invention.

In a preferred embodiment, the angle, indicated by the arrow "A", in FIG. 2 formed between the side line 90 and the oblique side line 86 preferably is about 135 degrees. The angle defined by the oblique side line 84 and the neck side line 88, indicated by the arrow "B" in FIG. 2, is also about 135 degrees. By keeping these angles large, there is reduced tendency toward damage to the front panel when a pulling force is applied to the tear-away tab during its removal, and in the instance of the angles "A" and "B", there is no necessity to alter the perforation pattern at this location away from that perforation pattern which is selected to provide relatively greater resistance to tearing away of the tear-away tab along the side lines thereof along the lower portion of the neck section and along the oblique side lines. Accordingly, the tear-away tab is retained securely integral with the front panel during erection of the container, filling, shipment, and storage of the container.

The erected container 130 is depicted in FIG. 2. The container includes a front side wall 14, opposite side walls 18 and 20, and a rear side wall 16 formed from the front panel, the side panels, and the rear panel by having been folded along the fold lines 20, 21, 22, and 24. The glue flap 12 serves to bond one edge of the side panel 18 to the rear panel 20. The top end 132 of the container is closed by the dust flaps 44 and 46 and the top end closure flap 60. The bottom end 134 of the container is closed by the dust flaps 52 and 54 and the bottom end closure 64. The front side wall 14 includes the tear-away tab 66.

The container of the present invention is particularly useful as an erect dispensing container for flat, thin items 93 (see FIG. 4) of a given product held in stacked relationship within the container. In particular the container is useful in the shipment, storage and, in use, dispensing of neonatal electrode covers. The use of a dispensing container for this type product presents the problems of how to retain the products within the container while simultaneously presenting individual ones of the product for removal from the container. In the medical care environment, time is often of the essence so that ease of withdrawal of an individual product from the dispensing container efficiently and repetitively is paramount. Further, it is important in this environment that there be provided a means for indicating the level of supply of the product items remaining available within the container, since unexpected exhaustion of product can be most serious. Still further, replacement of an empty container with a fresh container of products needs to be a quick and easy operation. In the present dispensing container, these objectives are accomplished by means of the geometry of the tear-away tab and the unique patterns of perforations and cuts through the thickness of the front panel that define the means by which the tear-away tab is initially retained integral with the container during filling, shipment and storage, for example, and by which the tear-away tab is readily and easily removed from the front panel of the container to provide an opening in the front panel which functions to present the product items for individual removal from the container through the opening, and to further provide a visual indication of the level of supply of product items remaining in the container.

Figure 3:
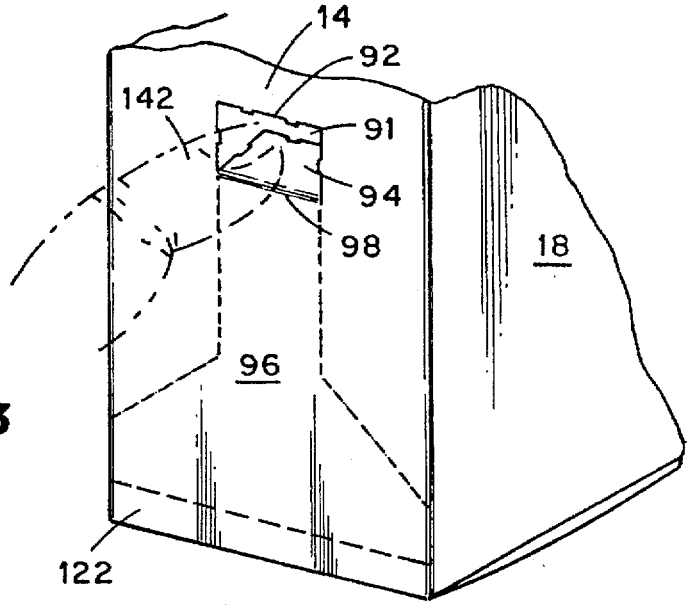
FIG. 3 is a cutaway perspective view of a portion of the bottom of the container depicted in FIG. 2 and showing the initial opening of the removable closure tab thereof; and, FIG. 4 is a cutaway perspective view of the portion of the bottom of the container depicted in FIG. 3 and showing the completed removal of the closure tab of the container to reveal the contents of the container.

With specific reference to FIG. 3, to easily and readily remove the tear-away tab from the front panel of the container of the present invention, using the end of a finger 142, one applies an inwardly directed force against the upper portion of the neck section of the tear-away tab, above the fold line 98 to rupture the relatively few uncut portions of the front panel that separate the perforations along the top side line 92 and along those portions of the opposite neck side lines that bound the upper portion of the neck section. This action causes the upper portion 94 to fold inwardly of the container along the fold line 98 and permit the further insertion of the distal joint of the finger 142 into the container whereupon the distal joint is bent to permit the finger to exert a pulling force directed outwardly and downwardly of the container and against the lower portion of the neck section. Simultaneously, the lower portion 96 may be engaged by the person's thumb to capture the folded back upper portion 94 and the lower portion 96 of the neck section 66 between the finger and thumb. Exertion of further pulling force to the neck section outwardly and downwardly of the container effects easy and ready full tearing away of the tear-away tab to expose an opening 91 in the front panel that resembles an inverted funnel. Even though this type of outwardly and downwardly directed pulling force would be expected to damage the paperboard of the front panel, and thereby destroy, at least partially, the integrity of the front panel, hence its ability to retain and present products for removal therefrom, it has been found that such damage does not occur in the present invention.

Figure 4:
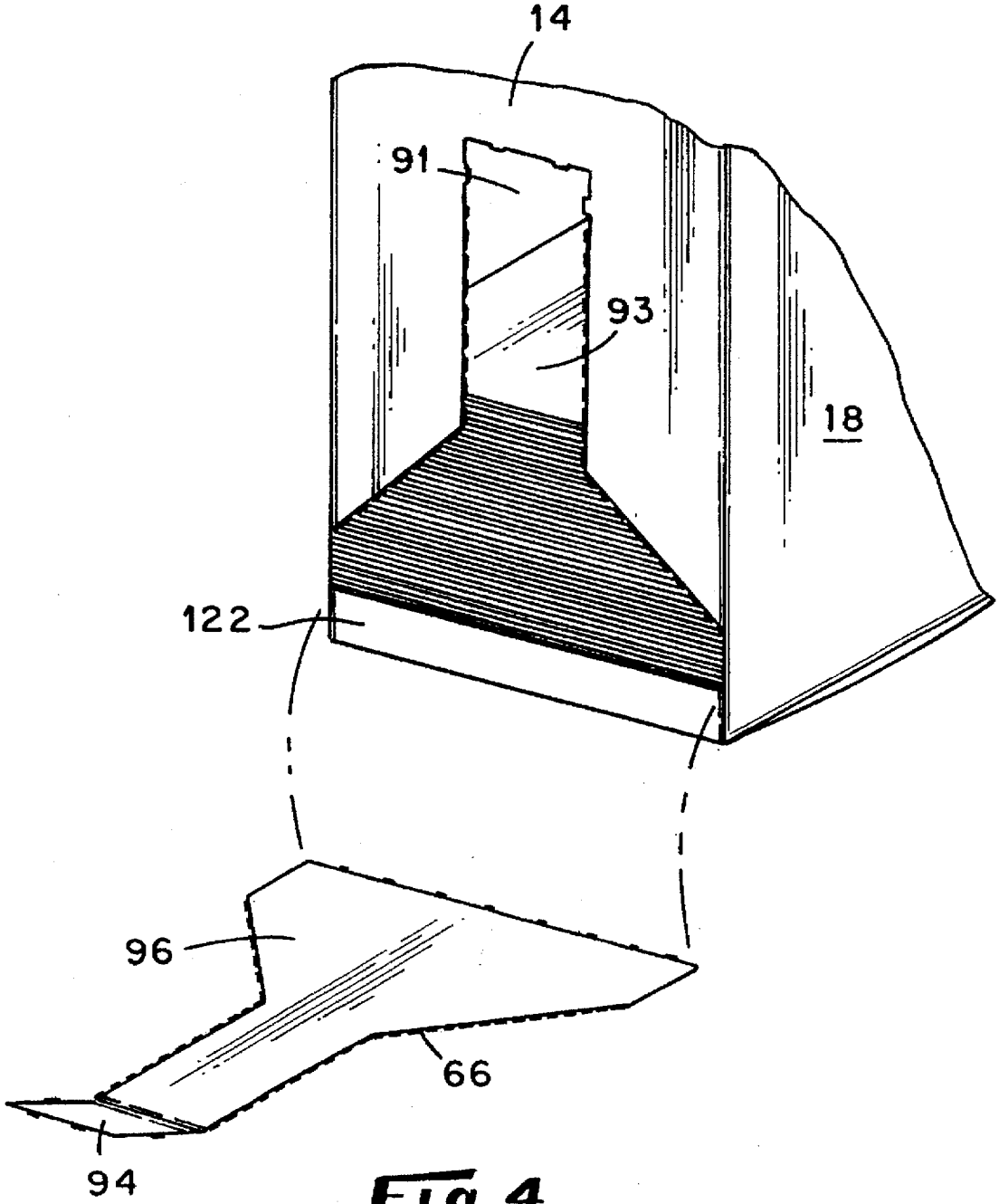

Further, as depicted in FIG. 4, the provision of the "closed" bottom portion 122 of the front panel located directly beneath the bottom edge of the opening 91 defines a retaining wall that serves to prevent the most bottom one of the products 93 within the stack stored within the container from being removed from the container until all other of the products items of the stack have been removed from the container. In this manner, this most bottom one or more of the products serves as a friction platform from which that product immediately above the bottom one(s) in the stack and exposed through the opening, can be removed as a single unit and without disturbing the remaining products in the container.

As also seen in FIG. 4, the open neck section of the opening 91 exposes the presence of products remaining in the container and provides a visual proximation of the quantity of products remaining in the container.

What is claimed:

1. A dispensing container suitable for use in an erect position and having top and bottom ends, for a plurality of like flat, thin products disposed in stacked relationship within the container comprising front, side and rear panels defining the container, and including top and bottom closures for the container, an easy opening tear-away closure tab provided on the front panel, the tear-away portion being defined by a plurality of different perforation patterns and having a profile that includes a truncated pyramidal base section including an apex and a base that extends substantially fully across the width dimension of said front panel and which is disposed above and spaced apart from the bottom end of the container and an elongated neck section, including a top side and opposite sides thereof and being divided into upper and lower portions by a fold line extending between said opposite sides, which is a continuation of the apex of said base and which is more narrow in width than said base of said base section, said base of said pyramidal base section being removably secured to the front panel by a first line of perforations that extends fully across the width dimension of the front panel, said neck section being removably secured to the front panel by a further pattern of perforations that extends along each of the opposite sides of the neck section from at least the apex of the base section to the intersection of the side lines of the neck section with the fold line, and further being removably secured to the front panel by a still further pattern of perforations that extends along each of the opposite sides of the neck section from the intersection of the opposite sides with the fold line to and along the top side of the neck section, said first pattern of perforations being of less tearing strength than said further pattern of perforations, and said further pattern of perforations being of greater tearing strength than said still further pattern of perforations, whereby the application of pressure to said upper portion of the neck section inwardly of the container readily effects the tearing away of the upper portion and provides an entrance to the interior of the container for infolding of the upper portion of the neck section and providing access for grasping the neck section at the fold line for exerting a tearing away force to the closure tab.

2. The dispensing container of claim 1 wherein the profile of the tear-away portion resembles an inverted funnel, the base section comprising the body of the funnel and the neck section comprising the spout of the funnel.

3. The dispensing container of claim 1 wherein the tear-away closure tab, in profile, includes a bottom side line that extends horizontally across the front panel, opposite first and second side lines that extend upwardly from the bottom side line at an angle of about 90 degrees, opposite first and second oblique side lines that extend upward and inwardly converging from respective ones of the first and second side lines, opposite third and fourth side lines that are spaced apart from one another and which extend upwardly from respective ones of the first and second oblique side lines, and a top side line extending horizontally between and joining the third and fourth side lines.

4. The dispensing container of claim 3 wherein the bottom side line of the opening is disposed at a horizontal height above the bottom of the container by a distance substantially equal to the thickness of at least one individual product contained within the container.

5. The dispensing container of claim 3 including junctures between the bottom side line and respective ones of the opposite first and second side lines, and these junctures are cut fully through the thickness of the front panel.

6. The dispensing container of claim 3 including junctures between the third and fourth side lines and the top side line, and these junctures are cut fully through the thickness of the front panel.

7. The dispensing container of claim 3 wherein the perforation pattern defining the bottom side line offers less resistance to tearing than the resistance to tearing afforded by the perforation pattern that defines the first and second oblique side lines.

* * * * *